US006205807B1

(12) United States Patent
Broadbent

(10) Patent No.: US 6,205,807 B1
(45) Date of Patent: Mar. 27, 2001

(54) LOW COST ICE MAKING EVAPORATOR

(76) Inventor: John A. Broadbent, 5558 S. Yampa St., Aurora, CO (US) 80015

( * ) Notice: Subject to any disclaimer, the term of this patent is extended or adjusted under 35 U.S.C. 154(b) by 0 days.

(21) Appl. No.: 09/421,922

(22) Filed: Oct. 20, 1999

Related U.S. Application Data

(60) Provisional application No. 60/122,286, filed on Mar. 1, 1999, and provisional application No. 60/104,910, filed on Oct. 20, 1998.

(51) Int. Cl.[7] ..... F25C 1/00
(52) U.S. Cl. ..... 62/347; 62/352
(58) Field of Search ..... 62/347, 348, 352

(56) References Cited

U.S. PATENT DOCUMENTS 2,677,249 * 5/1954 Mason ..... 62/347
4,649,718 * 3/1987 Linstromberg et al. ..... 62/347
4,986,088 * 1/1991 Nelson ..... 62/347
5,097,897 * 3/1992 Watanabe et al. ..... 165/140
5,182,925 * 2/1993 Alvarez et al. ..... 62/347
5,493,872 * 2/1996 Hibino et al. ..... 62/347
5,941,091 * 8/1999 Broadbent ..... 62/347

* cited by examiner

*Primary Examiner*—Corrine McDermott
*Assistant Examiner*—Mohammad M Ali
(74) *Attorney, Agent, or Firm*—Gibson, Dunn & Crutcher LLP

(57) ABSTRACT

An ice cube making evaporator design comprising an aluminum roll-bond evaporator plate (50) which is encased in a plastic grid (59) of vertical and horizontal ridges, thereby forming an array of freezing sites (28) on both sides of the plate. Plastic grids (59) are attached to each other using thermal staking, adhesives or welding so that the plate (50) is securely sandwiched between the two plastic grids (59).

17 Claims, 13 Drawing Sheets

LOW COST ICE MAKING EVAPORATOR

PRIORITY CLAIMS

This application claims the benefit of United States Provisional Patent Application No.'s 60/104,910, filed Oct. 20, 1998, and 60/122,286, filed May 1, 1999.

TECHNICAL FIELD

This invention pertains to the field of ice cube making machines, and in particular to a low cost, high-performance ice making evaporator design.

BACKGROUND OF THE INVENTION AND PRIOR ART

Ice machines are widely used in restaurants and the like for producing ice, in the form of flakes, chips, cubes, etc. for use in beverages and for other uses relating to food and drink services. Generally, these ice machines include a refrigeration apparatus for freezing water supplied to the machine, a means for periodically removing, or "harvesting" ice from the freezing surface, and a cabinet or bin for storing the ice until it is needed.

In a typical ice making apparatus, water is brought in contact with a refrigerated surface, usually referred to as the evaporator, to be frozen. Freezing takes place for an interval of time, typically fifteen to twenty minutes, until the size of the ice cube is adequate. At this point, the harvesting operation takes place to remove the cubes from the evaporator. When harvested, the ice cubes typically fall off of the evaporator and are directed into an ice holding bin.

Ice making evaporators are typically constructed using stainless steel or nickel-plated copper. These materials are used because of their suitability for use with potable water and their heat transfer characteristics. Copper for example, is an excellent conductor of heat and therefore is well suited for use in ice machines. Stainless steel is also used extensively in ice making evaporators because of its non-corroding properties and suitability for contact with potable water. While these materials are well suited for use in ice machine evaporators, they can be expensive to use and fabricate.

An example of an ice making evaporator that is commercially available is provided in U.S. Pat. No. 4,458,503 to Kenneth L. Nelson. This patent describes an ice making evaporator consisting of a serpentine copper tube to which a series of formed, nickel-plated copper strips are attached. The entire assembly is placed into an injection mold and molded over with a plastic material. All of the copper tubing and portions of the copper strips are molded over with plastic. Other portions of the copper strips are left bare (free of plastic) to provide a good heat transfer path from the water and ice to the refrigerant. These bare portions of the evaporator plate provide the locations where the ice cubes form.

Another example of a commercially available ice making evaporator is provided in U.S. Pat. No. 5,479,707 to Alvarez, et al. This patent describes an evaporator constructed from sheets of stainless steel which are stamped, punched and then welded together to create a flat-walled serpentine refrigerant passage. This stainless steel serpentine is placed into an injection mold and molded over with a plastic material to create ice cube formation sites of the desired shape. The stainless steel is left exposed in the locations where ice is to form so as to improve heat transfer. In this design the ice cubes form on these exposed areas, which are also the stainless steel walls of the refrigerant passage.

Both of the evaporator designs referenced above utilize relatively expensive tooling, processes and materials to create the evaporator assemblies.

A primary objective of this invention is to utilize materials and manufacturing processes that are inherently low in cost in order to reduce substantially the cost of an ice making evaporator.

Another primary objective of this invention is to optimize the heat transfer performance of the evaporator assembly through its ice forming geometry and refrigerant circuiting.

Another primary objective of this invention is to minimize the thermal mass of the evaporator assembly. Since an ice machine evaporator is constantly cycled between hot and cold temperatures, lowering the thermal mass of the assembly will result in less energy being needed to heat and cool the assembly between those temperatures.

Another primary objective of this invention is to provide a freezing surface that meets the ice machine sanitation requirements of the National Sanitation Foundation (NSF).

The present invention achieves these objectives utilizing a uniquely formed aluminum roll-bond type evaporator plate to which is attached a grid of plastic ridges which form an array of ice cube forming sites on both sides of the plate. This plastic grid is comprised of thin vertical ridges and wider horizontal ridges. The vertical ridges act to separate horizontally-adjacent cube forming locations. The horizontal ridges act to separate vertically-adjacent cube forming locations and to cover the refrigerant passages of the roll-bond evaporator plate. Additional features not previously used in ice making evaporators are also incorporated into the present invention to improve ice-making performance and allow this configuration to be easily manufactured.

The low cost of the aluminum evaporator plate, the low thermal mass of the assembly, the geometry of the ice cube forming locations and the additional ice making improvements incorporated in this design provide superior heat transfer performance and significantly lower cost than existing ice making evaporator designs.

SUMMARY OF THE INVENTION

The invention herein comprises an ice making evaporator which can be inexpensively assembled with a novel combination of components manufactured with mature and relatively inexpensive manufacturing technologies. Harvesting ice from this evaporator is done using the traditional hot gas method, and requires no additional valves, piping, controls or moving parts.

As used herein, the term "cube" shall not be limited to describing a regular solid piece of ice with six sides, but includes solid pieces of ice of any suitable shape.

In the preferred embodiment, an aluminum roll-bond type evaporator plate serves as the core of the evaporator assembly. This type of evaporator is lightweight, low cost and has a low thermal mass (thermal mass being equal to the weight of the materials used multiplied by their specific heat). It is of a type commonly found in domestic household refrigerators. This type of evaporator is basically a flat sheet of aluminum having an integrally formed serpentine refrigerant passage running through it.

To complete the evaporator assembly, a plastic gridwork is attached to either side of the aluminum evaporator plate. This plastic grid forms an array of exposed aluminum areas each separated from the next by ridges of plastic. In operation, ice will form on the exposed aluminum areas (freezing sites), and will tend not to form on the significantly less conductive plastic ridges.

In addition to the novel configuration of the refrigerant passages and the plastic grid, there is another feature that further improves the reliability of the evaporator. A water distribution tube mounted on the top of the evaporator is uniquely configured to direct water through small upward-facing distribution holes in order to supply a stream of water to the surface of the evaporator. Since the water distribution holes are the smallest orifices though which the ice making water circulates, these holes tend to act as a filter, catching whatever debris is floating or suspended in the water. Making these holes upward facing allows them to be effectively flushed-out each time the water flow through the water tube is stopped.

Since the water flow is typically stopped during each ice making cycle, the water in these upward facing holes will reverse (flowing backwards) each ice making cycle. This back-flow of water will tend to flush out any debris caught in the holes. Also, as the flow of water may have been the only thing holding the debris in the hole in the first place, stopping the water flow will allow gravity to help clear debris from the holes. Thus by utilizing upward facing holes, the water distribution tube has been effectively transformed into a "self-cleaning" water tube.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
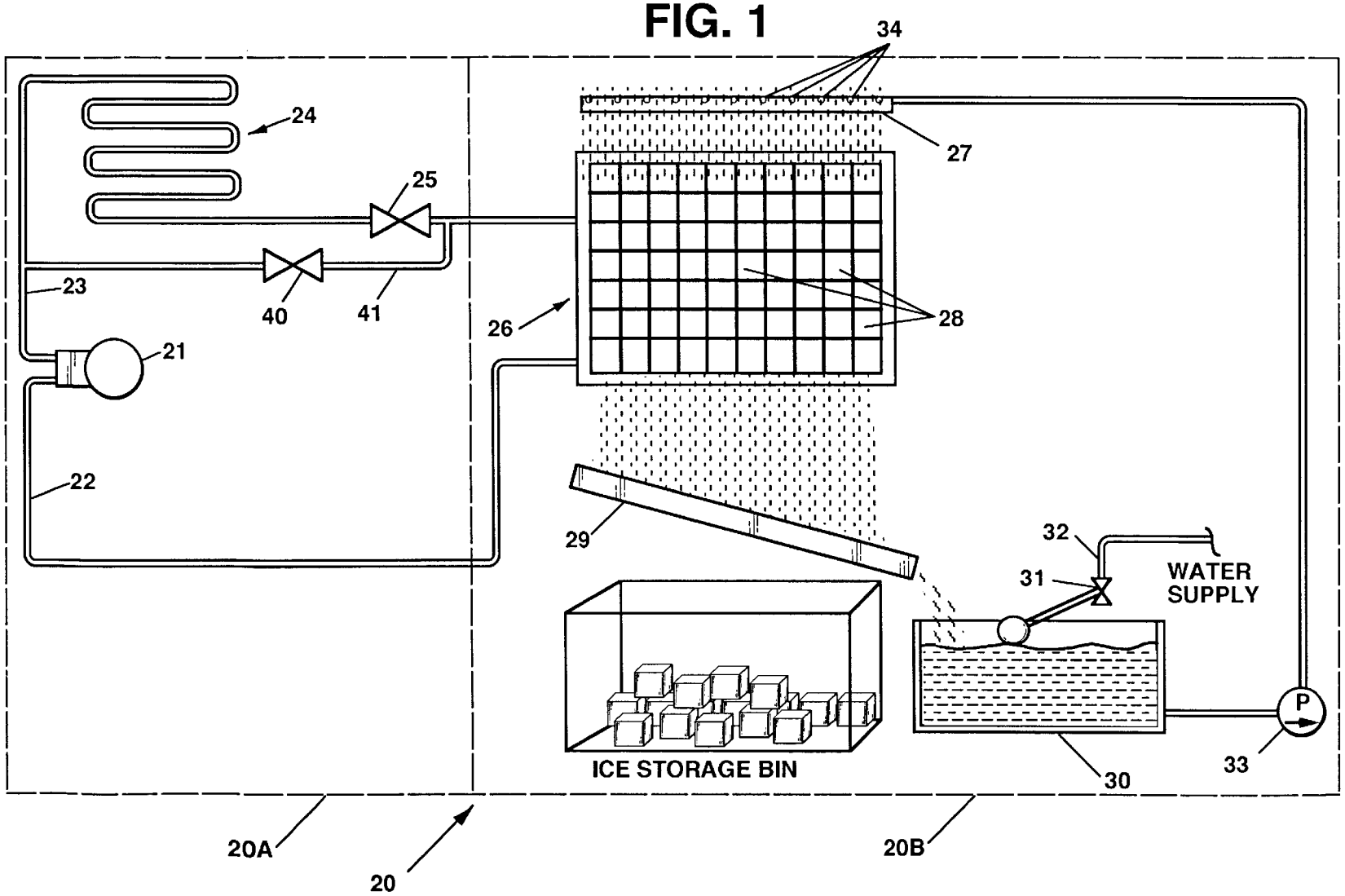
FIG. 1 is a schematic diagram illustrating the refrigeration circuit and the water supply circuit of the present invention.

Referring now to the Drawings, wherein like reference numerals designate like or corresponding parts throughout the views, and particularly referring to FIG. 1, there is illustrated a schematic diagram of a refrigeration circuit 20 incorporating the invention. The refrigeration circuit 20 is divided into two segments 20A and 20B.

The segment 20A comprises that portion of the refrigeration circuit 20 that contains certain conventional elements. These elements include a compressor 21 having a suction line 22 and a discharge line 23. In the discharge line 23 there is a condenser 24 for condensing the compressed refrigerant vapor coming from the compressor 21, and an expansion valve 25 for flashing a portion of pressurized liquid refrigerant into a vapor thereby lowering the temperature and pressure of the remaining un-vaporized refrigerant. Also shown is a hot gas valve 40 and a hot gas line 41 for supplying the evaporator with hot, high-pressure refrigerant gas directly from the compressor during the harvest portion of the ice making cycle.

The segment 20B comprises that portion of the refrigeration circuit 20 incorporating the present invention. To complete the refrigerant circuit 20, an evaporator assembly 26 is connected between the discharge line 23 and the suction line 22. The details of evaporator assembly 26 comprise the present invention, as will be described hereinbelow.

Gaseous refrigerant is compressed, condensed to a liquid and then expanded, in the form of a liquid spray into the evaporator assembly 26. Heat transferred into the liquid refrigerant causes it to evaporate. The evaporated refrigerant passes through suction line 22 back to the compressor 21.

FIG. 1 also illustrates the water supply circuit used to provide water to the evaporator assembly 26 for making ice. A water distribution tube 27 distributes a continuous stream of water through water distribution holes 34 and then down across the front and rear surfaces of the evaporator assembly 26. The water that is not frozen at the freezing sites 28 while crossing the evaporator is collected below in a collection trough 29. The water then flows back into a tank or reservoir 30. A constant level of water is maintained in the reservoir 30 by means of a float valve 31 (or other like means) that regulates flow from the water supply 32. A pump 33 circulates water from the reservoir 30 to the water supply manifold 27.

Figure 2:
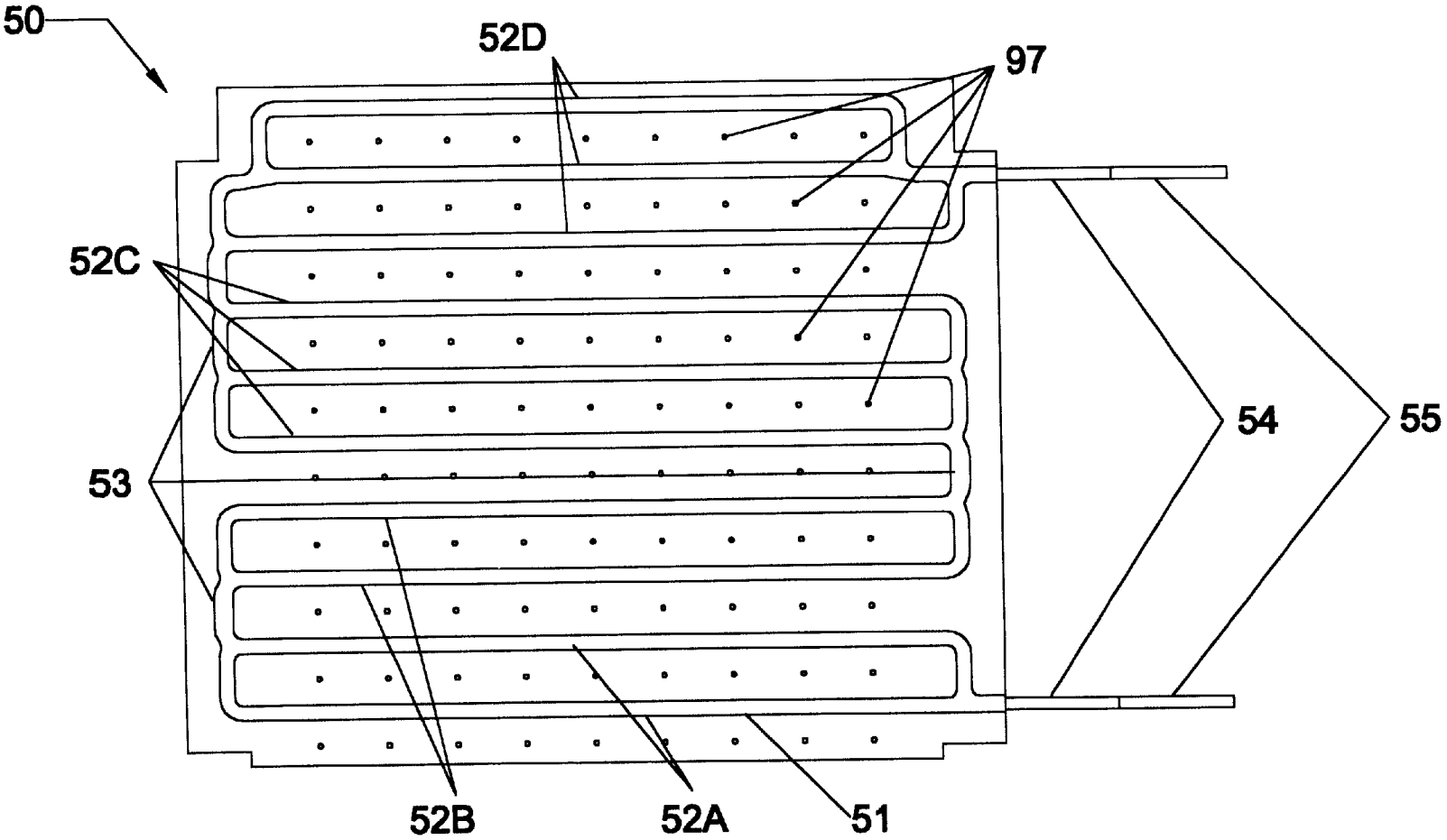
FIG. 2 is a plan view of the aluminum roll-bond evaporator plate.

FIG. 2 is a plan view of the aluminum roll-bond evaporator plate 50 that is a component in the evaporator assembly 26 of FIG. 1. The evaporator plate 50 is of a type produced by Algoods, Inc. (Toronto, Ontario, Canada) and consists of a flat sheet of aluminum within which exists an integral serpentine refrigerant passage 51. Conceivably, other materials could also be used to construct the evaporator plate 50 such as aluminum alloys, copper or other suitably conductive metals.

A roll-bond evaporator (such as evaporator plate 50) is fabricated by rolling together two sheets of aluminum, applying heat and pressure during the rolling process such that the two sheets are effectively welded together into a single sheet. By applying a special coating (sometimes referred to as "weld stop") between the sheets prior to the rolling/welding operation, it is possible to prevent the two sheets from welding together in the areas where the coating is applied. Thus by applying the coating in a serpentine pattern, it is possible to create a serpentine-shaped unwelded region within this welded part. By subsequently applying hydraulic or pneumatic pressure to this unwelded region, it is possible to inflate the unwelded serpentine region to form a serpentine passage through the plate. Thus a plate with an integral serpentine passage can be created in a very cost-effective manner. This type of evaporator is commonly used in domestic refrigerator applications where low cost is of extreme importance.

For use in ice making applications, the surface of the aluminum evaporator plate 50 should be anodized, plated or otherwise coated with a material judged suitable for food contact by NSF to protect the plate from corrosion.

As shown in FIG. 2, the evaporator plate 50 has an integrally-formed serpentine refrigerant passage 51 which splits and recombines the refrigerant flow several times as the refrigerant passes through the plate 50. In this embodiment, serpentine refrigerant passage 51 consists of ten straight sections or passes 52 and U-bends 53. In passes labeled 52A and 52B, the refrigerant flow is split into two separate flow paths. In passes 52C and 52D, the refrigerant flow is split into three separate flow paths. In between these sections, the refrigerant flow is recombined as it passes through the U-bends 53. In a similar manner, a roll-bond type evaporator plate may be designed to split the flow of refrigerant into as many flow paths or circuits as are necessary to achieve the desired pressure drop through the plate. The more refrigerant circuits, or splits, the lower the corresponding pressure drop. However, too many circuits or splits can result in uneven refrigerant flow distribution and/or low refrigerant velocities that can adversely affect performance (e.g., poor oil-return characteristics, reduced heat transfer coefficients). The tube diameter of passes 52 and U-bends 53 may also be increased to reduce pressure drop, although increasing the tube diameter may consequently reduce the ultimate burst strength of the evaporator plate 50. Also, recombining the refrigerant flow into a single flow path several times as it passes through the plate 50 (specifically as it passes through U-bends 53), helps to keep the flow of refrigerant even through the entire plate 50. This recombining of the flow reduces the possibility that any one refrigerant pass will become "starved" of refrigerant.

In the embodiment of evaporator plate 50 illustrated in FIG. 2, the refrigerant is intended to enter the bottom of the plate, travel in sequence through passes 52A, 52B, 52C and 52D, and then exit through the top of plate 50. In this way, the refrigerant is split more (into three circuits) just before it exits the plate 50. This allows the exiting refrigerant, which is mostly gas and consequently has greater volume, to have a larger cross-sectional flow area than the refrigerant entering the plate, which is mostly liquid and consequently has less volume. This is intended to further minimize refrigerant pressure drop by giving more cross-sectional flow area to the sections of the refrigerant path which have a higher volume flow rate of refrigerant.

At one end of the evaporator plate 50 are tube stubs 54 and 55 used to connect the refrigerant passage 51 to the refrigeration circuit of the ice machine. In the preferred embodiment, tube stubs 54 are aluminum so that they can be readily bonded to the aluminum of evaporator plate 50. Tube stubs 55 are copper to allow convenient connection to the other refrigerant conduits in the ice machine, which are typically copper. The joint between aluminum tube stubs 54 and copper tube stubs 55 must be coated or covered with an electrically insulating material in order to prevent galvanic corrosion from occurring between these two dissimilar metals.

Also shown in FIG. 2 are holes 97 that will be used for attaching plastic grids to the evaporator as will be described in further detail herein below.

Figure 3:
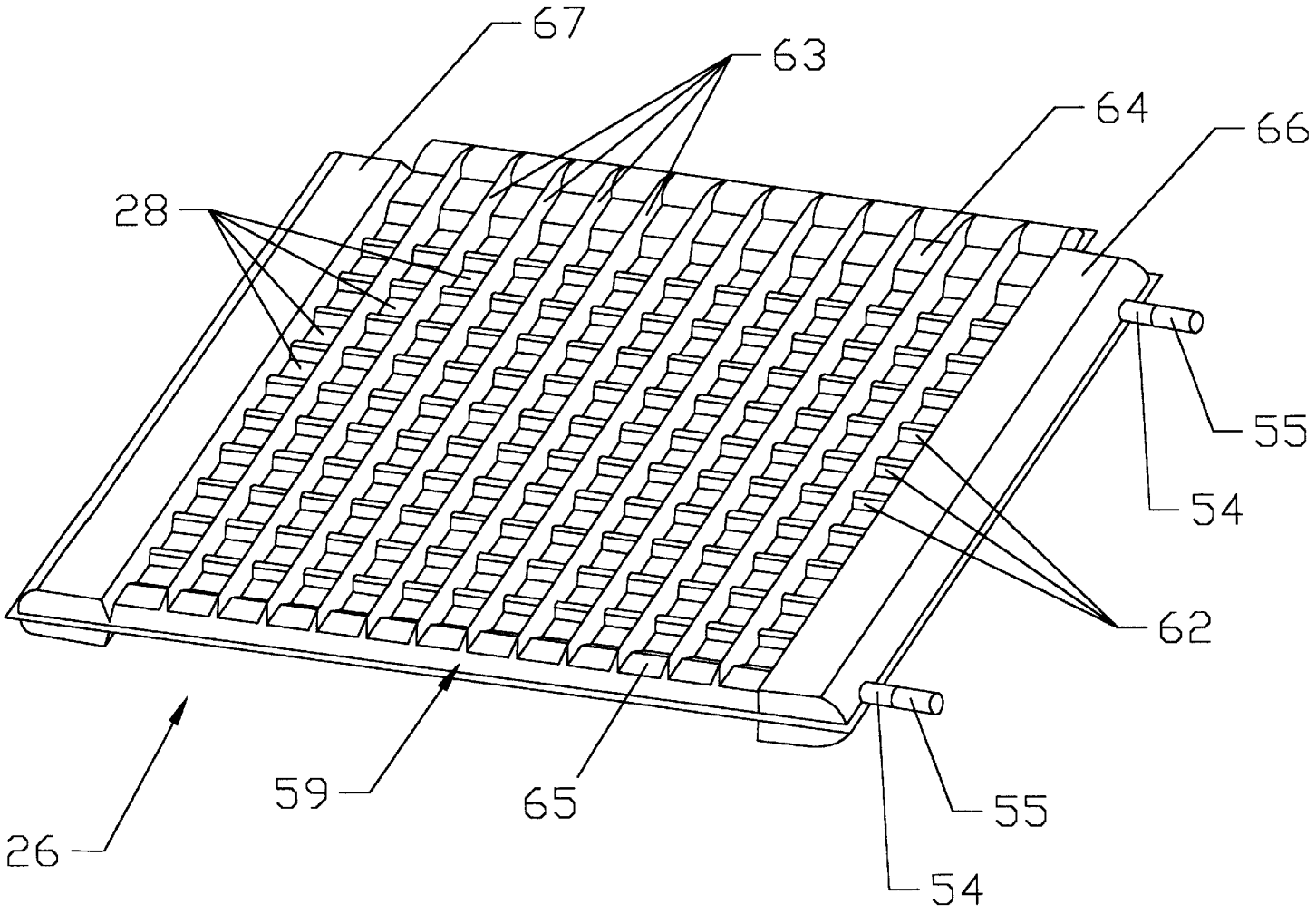
FIG. 3 is an isometric view of the evaporator assembly.

FIG. 3 is an isometric view of the evaporator assembly 26. The evaporator assembly 26 is comprised of a roll-bond aluminum evaporator plate 50 on either side of which has been attached plastic grids 59 (only one of the two grids 59 is visible in FIG. 3). The plastic grids 59 are comprised of horizontal ridges 62 and vertical ridges 63 that define an array of rectangular freezing sites 28 on either side of the evaporator plate 50. The purpose of the vertical ridges 63 is to define the freezing sites 28 so that horizontally adjacent ice cubes do not freeze together. The purpose of the horizontal ridges 62 is to define freezing sites 28 so that vertically adjacent ice cubes do not freeze together. The horizontal ridges 62 are also designed to completely cover or straddle the straight refrigerant passes 52, as will be explained in detail herein below.

The plastic grids 59 on the front and back of the evaporator assembly 26 (only the front grid 59 is visible in FIG. 3) are injection-molded plastic parts. These grids 59 are preferably molded from a plastic material that is approved for food zone use by NSF, such as Polyvinyl Chloride (PVC). In the preferred embodiment, grids 59 are designed such that the grid 59 that is attached to one side of evaporator plate 50 is identical to the grid 59 that is attached to the other side of evaporator plate 50. By keeping the two grids 59 identical, only a single injection mold will be needed to produce the parts. This results in a considerable cost saving relative to buying two molds to create two non-identical parts. The grids 59 are attached to each other so that the evaporator plate 50 is sandwiched securely in between them. Attachment of the two grids 59 is accomplished preferably by thermal staking as will be described herein below.

It should be noted that except for the freezing sites 28, the entire exterior of the evaporator assembly 26 consists of the molded plastic grids 59 that have been attached to evaporator plate 50. The freezing sites 28 are the only areas that are left free of plastic. This allows almost all of the heat transfer (and ice formation) to occur at the freezing sites 28 while minimizing the heat transfer (and extraneous ice growth) everywhere else.

Also shown in FIG. 3 are top and bottom insulating sections of plastic 64 and 65, respectively. Plastic sections 64 and 65 prevent ice from forming above or below, respectively, the array of freezing sites 28. There are also end-insulating sections 66 and 67 that prevent ice from forming on either end of the evaporator assembly 26. FIG. 3 also shows tube stubs 54 and 55 entering and exiting the evaporator assembly through the end insulating section 66.

Figure 4:
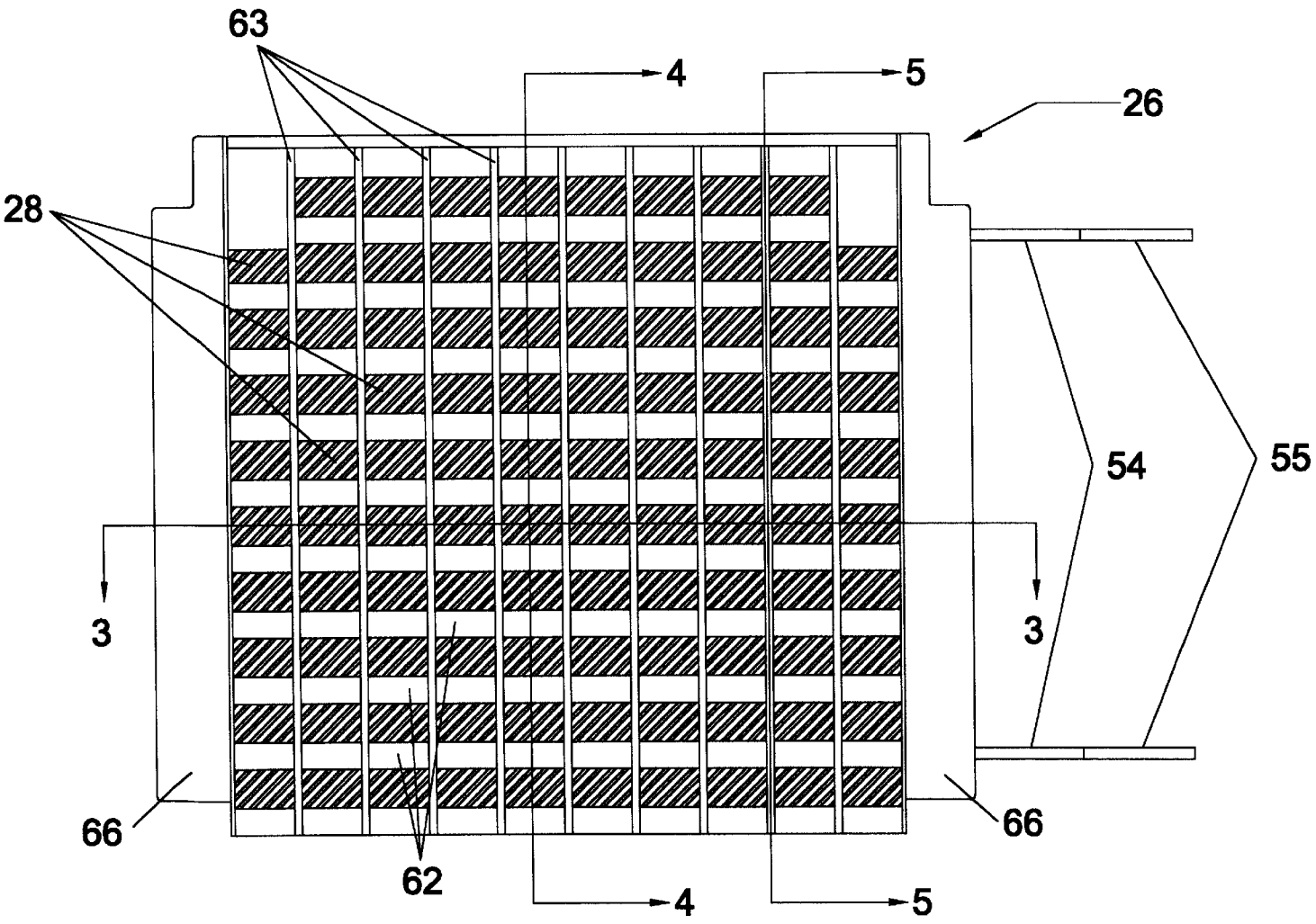
FIG. 4 is a plan view of the evaporator assembly.

FIG. 4 is a plan view of the evaporator assembly 26. FIG. 4 again illustrates the freezing sites 28, the tube stubs 54 and 55, the horizontal ridges 62, the vertical ridges 63 and the end-insulating sections 66.

Figure 5:
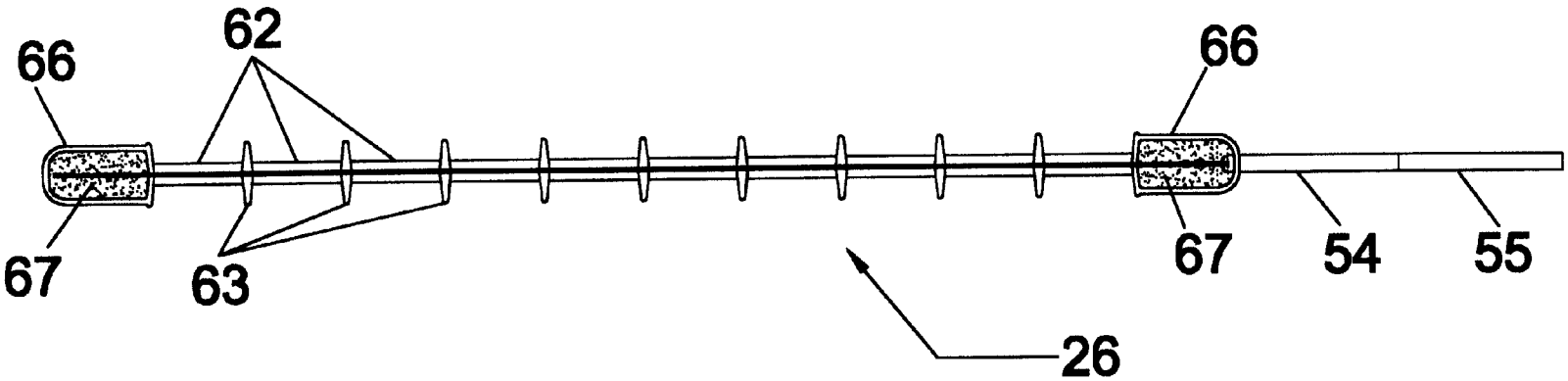
FIG. 5 is a cross-sectional view of the evaporator assembly taken along line 3—3 of FIG. 4.

FIG. 5 is a cross-sectional view of evaporator assembly 26 taken along line 3—3 of FIG. 4. FIG. 5 shows the end-insulating sections 66. Initially after the plastic grids 59 are attached to evaporator plate 50, the end-insulating sections 66 form a fairly large "pocker" between the plastic grid 59 and the evaporator plate 50 around the areas of evaporator plate 50 where U-bends 53 are located. Tolerances associated with the manufacture of the roll-bond evaporator plates causes the location of U-bends 53 to be highly variable. For this reason it is important that the plastic grids 59 provide plenty of room or allowance for U-bends 53 to be out of their nominal positions. The space between the evaporator plate 50 and the end-insulating sections 66 provides this room.

Once plastic grids 59 are attached to the evaporator plate 50, the hollow pockets created between end insulating sections 66 and the evaporator plate 50 are injected and/or filled with insulation 67. Insulation (urethane foam, for example) 67 provides the following benefits: 1.) It further insulates the ends of the evaporator plate 50 so that no extraneous ice forms on the end sections 66; and 2.) it displaces the air from within the end sections 66 so that moisture cannot be condensed out of the air and frozen onto evaporator plate 50. The insulation 67 used must either be suitable for food zone contact (per NSF requirements) or else be completely encapsulated within end sections 66 so that it cannot come into contact with the potable water in the ice making machine.

Figure 6:
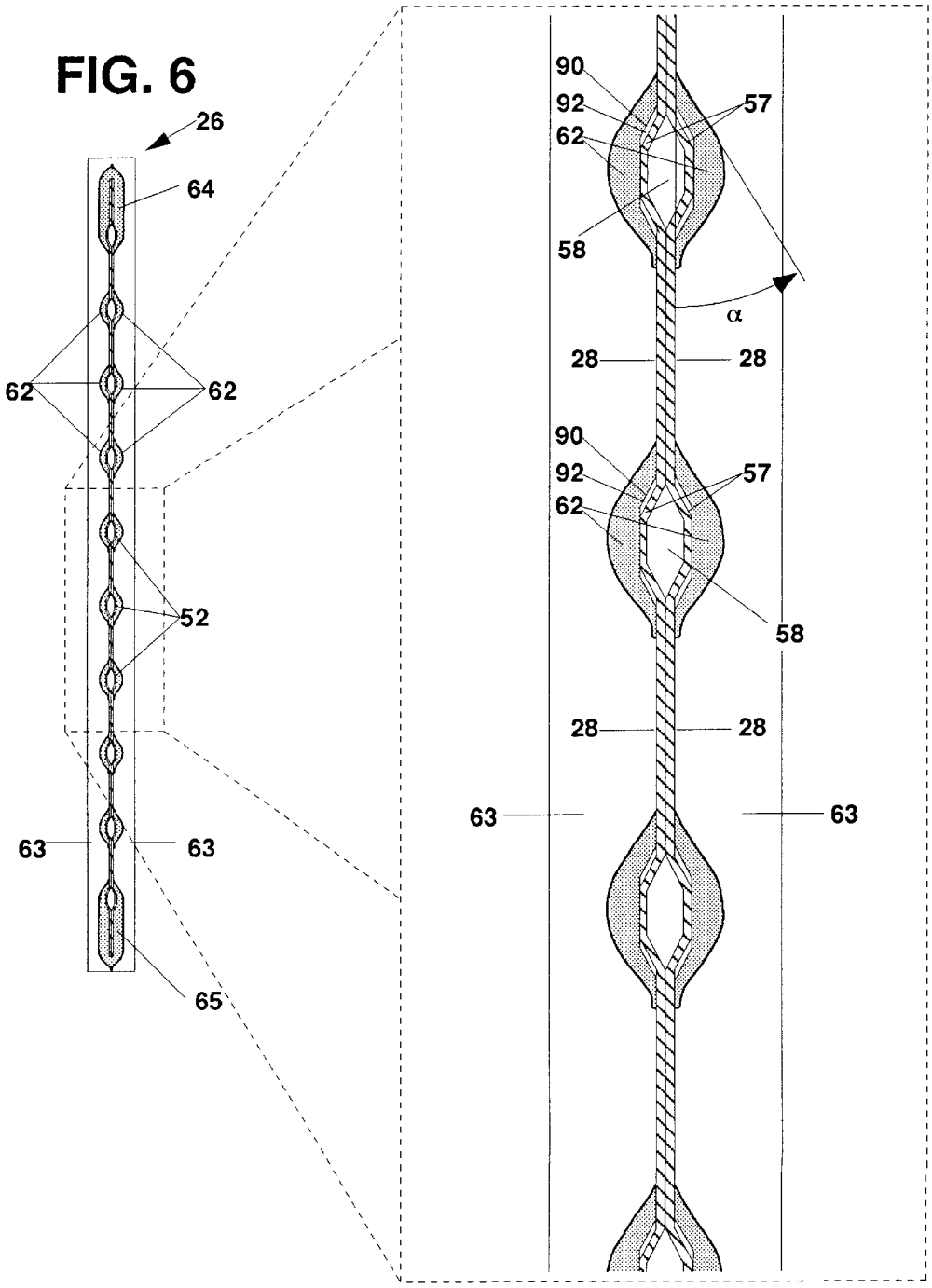
FIG. 6 is a cross-sectional view of the evaporator assembly taken along line 4—4 of FIG. 4.

FIG. 6 is a cross-sectional view of the evaporator assembly 26 taken along line 4—4 of FIG. 4. FIG. 6 shows that the plastic horizontal ridges 62 serve to define vertically the freezing sites 28. In this embodiment the horizontal ridges 62 completely cover or straddle the refrigerant passes 52. Because of manufacturing tolerances, the size and position of tube walls 57 are not the same from one evaporator to the next. To accommodate this manufacturing variation, the groove 90 on the inside of the horizontal ridges 62 must be larger than the space actually occupied by tube walls 57. This results in a gap 92 being created between the horizontal ridges 62 and the tube wall 57. This gap 92 can be filled, if desired, with an adhesive, sealant or fill material in order to keep moisture out of this area and to improve heat transfer and adhesion between horizontal ridges 62 to the roll-bond evaporator 50.

Also illustrated in FIG. 6 is the angle or slope of the upper portion of the horizontal ridges 62. Testing has shown that the slope of the upper portions of the horizontal ridges 62 significantly affects the harvesting, or ice release, speed of the evaporator assembly 26. A number of different horizontal ribs, each with a different upper portion slope angles ($\alpha$) were tested on an evaporator assembly in an ice machine. These tests showed that horizontal ribs having an angle $\alpha$ (the acute angle formed between the upper surface of the horizontal rib 62 and the vertical surface of the evaporator plate 50) that was greater than 36° harvested ice significantly slower than those with angle a that was 36° or less. During the testing, if no water flowed over the evaporator assembly 26 during the harvesting portion of the ice making cycle, ice cubes formed on horizontal ridges 62 where a was greater than 36° did not harvest at all. Thus the angle $\alpha$ between the surface of the upper portion of horizontal ridge 62 and vertical should be 36° or less.

Figure 7:
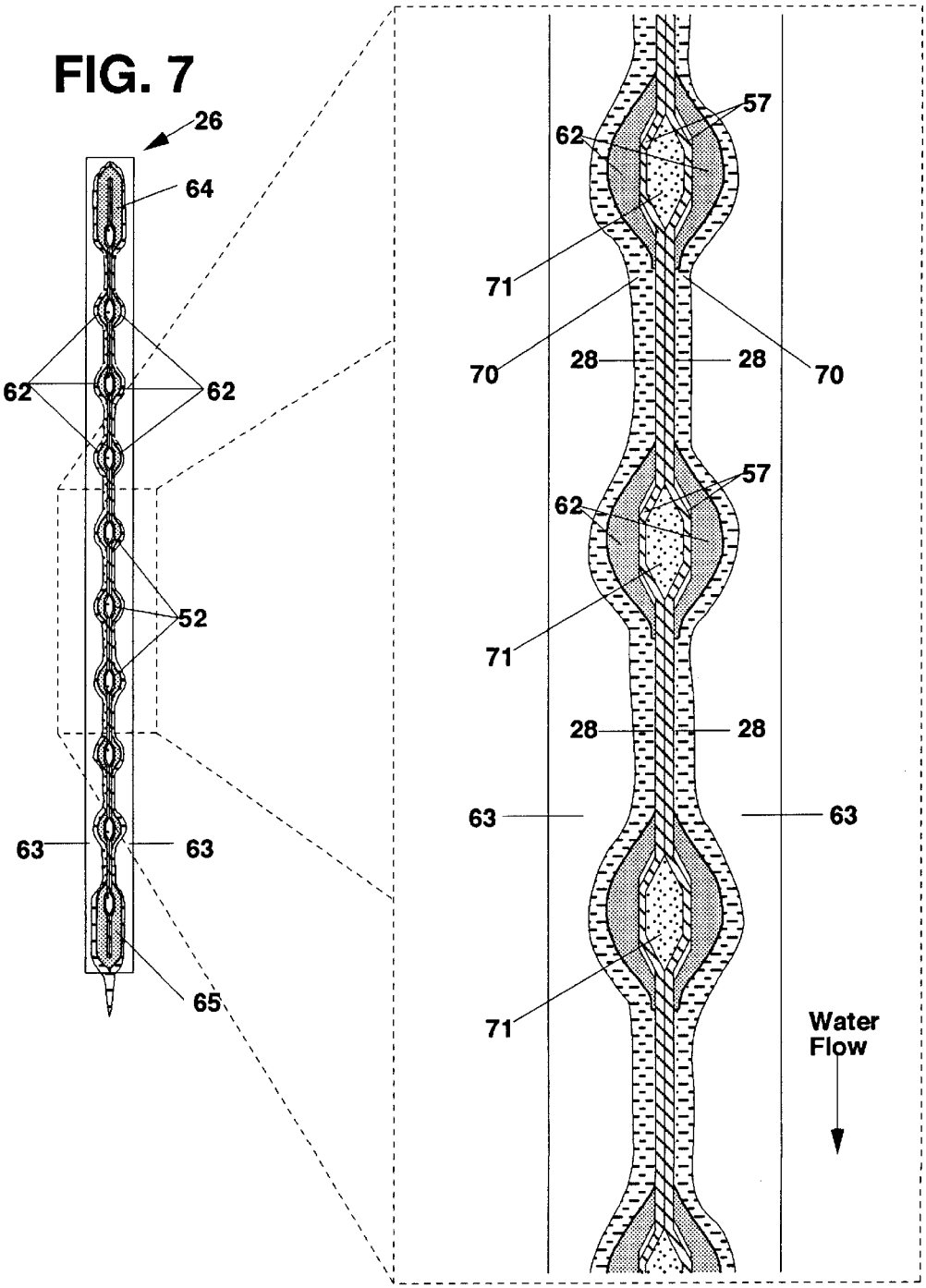
FIGS. 7 through 9 are cross-sectional views, taken along the line 4—4 of FIG. 4, illustrating the sequence of operation of the evaporator assembly.
Figure 8:
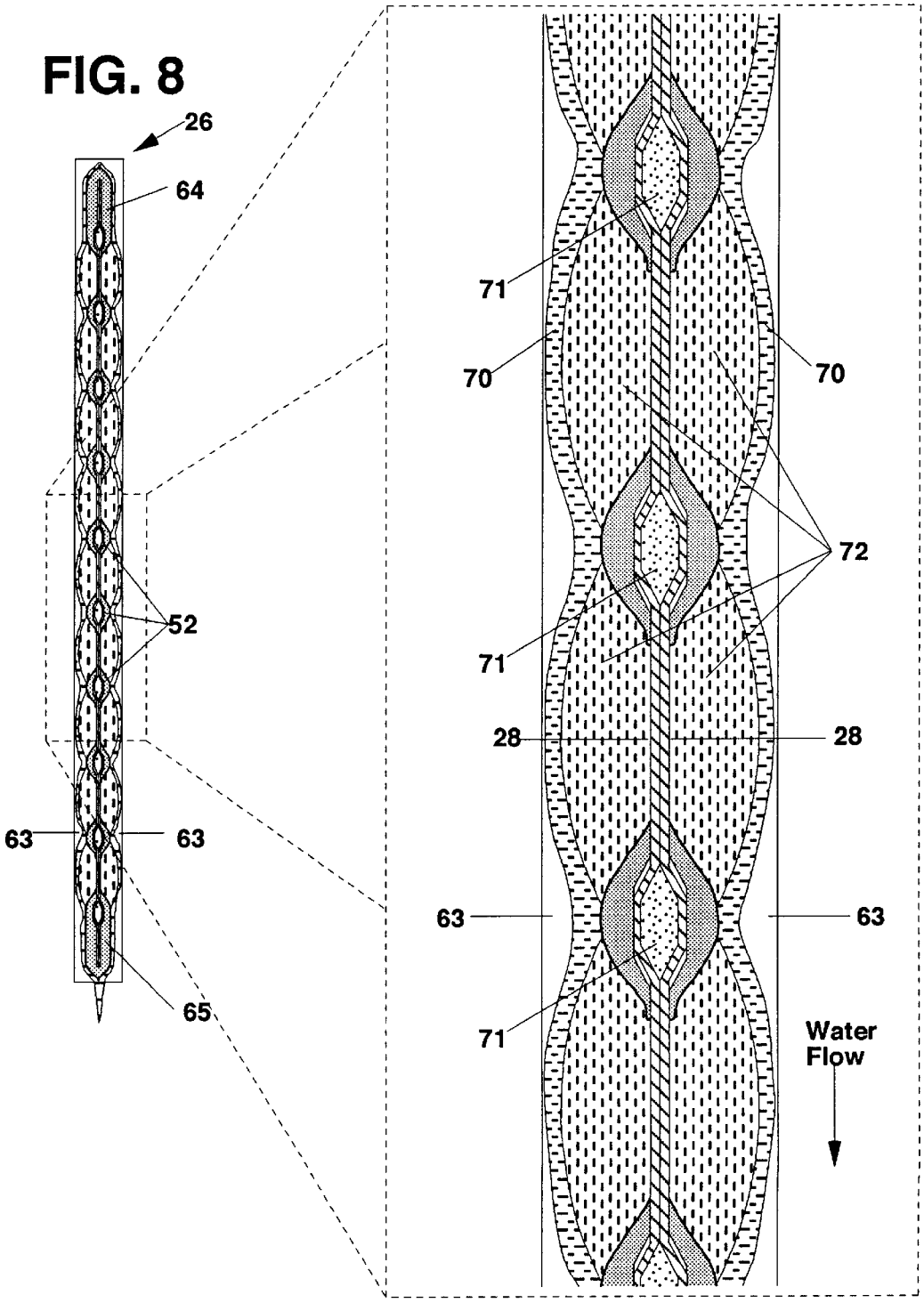
Figure 9:
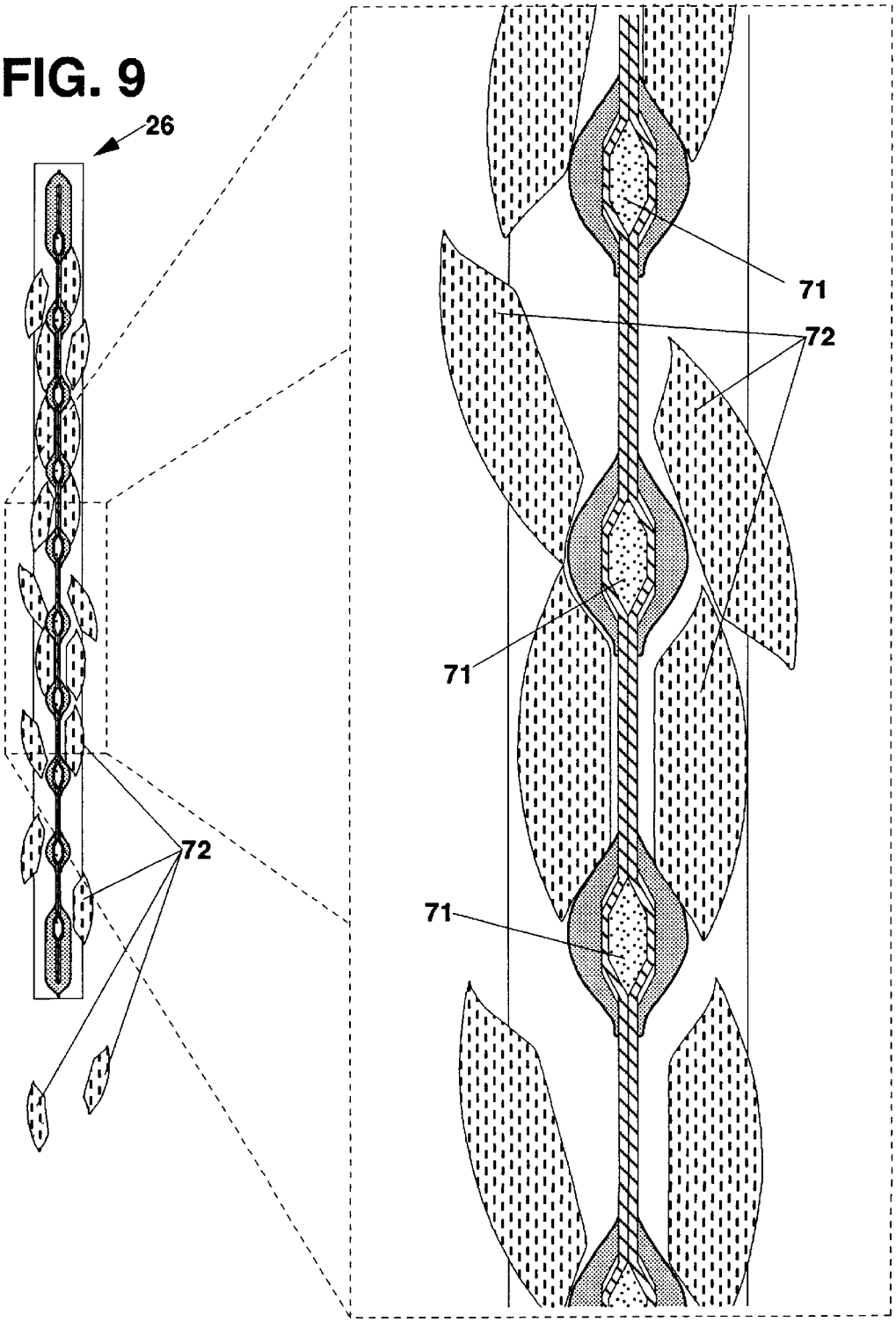

FIGS. 7, 8 and 9 are cross-sectional views of the evaporator assembly 26 taken along line 4—4 of FIG. 4, and illustrate the sequence of operation of the evaporator assembly 26. FIG. 7 shows the evaporator assembly 26 with water 70 flowing vertically down over it. This would occur during the portion of the ice making cycle in which the incoming water is cooled, prior to the actual forming of ice. Also shown is the low-pressure refrigerant 71 flowing through the hollow portion 58 of the refrigerant passes 52. During this portion of the ice making cycle, the refrigerant is a cold, low-pressure mixture of liquid and vapor. Water 70 is cooled by the transfer of heat from the water 70 into the aluminum at the freezing sites 28, through the aluminum evaporator plate 50, and into the cold refrigerant 71.

FIG. 8 shows the evaporator assembly 26 after ice cubes 72 have formed over the freezing sites 28 and illustrates how the horizontal ridges 62 separate the ice cubes 72 vertically from one another. During this portion of the ice making cycle, cold low-pressure refrigerant 71 continues to flow through the refrigerant passes 52.

FIG. 9 shows the evaporator assembly during the harvest part of the ice making cycle. During this part of the cycle, hot high-pressure refrigerant gas is caused to flow through the refrigerant passes 52. This causes the entire evaporator assembly 26 to warm up and subsequently causes the layer of ice bonding the ice cubes 72 to the evaporator assembly 26 to melt. This releases the cubes 72, which then fall off the evaporator assembly into an ice bin located below. While no water is shown flowing in FIG. 8, water may or may not be allowed to flow over the evaporator assembly 26 surface during this part of the ice making cycle.

Figure 10:
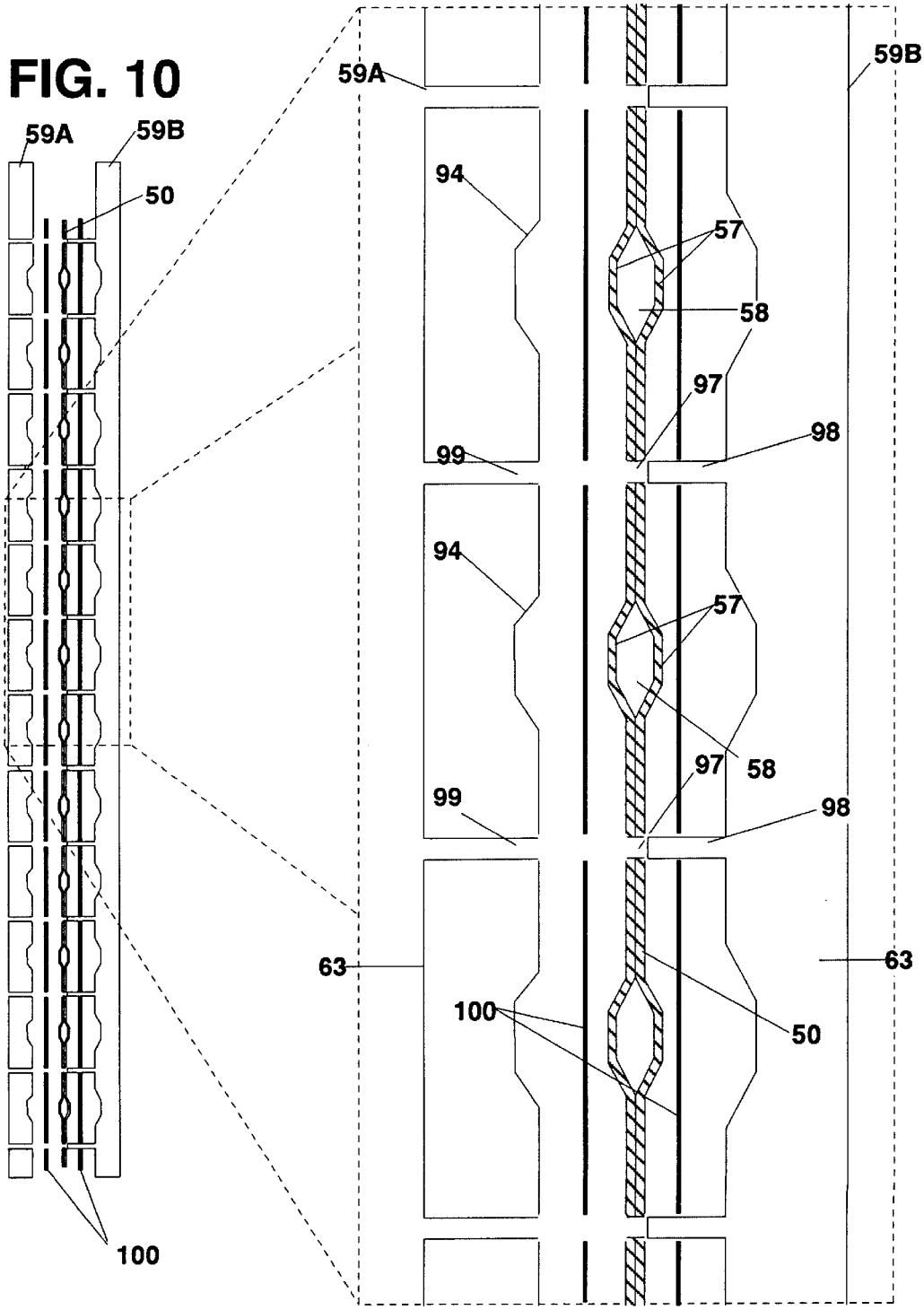
FIG. 10 is an exploded cross-sectional view of the evaporator assembly, taken along the line 5—5 of FIG. 4.

FIG. 10 is an exploded cross-sectional view of the evaporator assembly, taken along the line 5—5 of FIG. 4. In this view, plastic grids 59A and 59B are shown located along either side of the evaporator plate 50, as they would be just prior to assembly. Plastic grid 59B has a series of protrusions or pegs 98 that correspond to and fit through holes 97 in evaporator plate 50. Likewise, plastic grid 59A has a series of holes 99 that accommodate the pegs 98. Intervening between the grid 59A and evaporator plate 50 is a layer of sealing material 100. This sealing material 100 is an optional layer of material used to provide a more positive seal between the plastic grid 59 and the evaporator plate 50 to keep water from seeping in-between the evaporator plate 50 and the plastic grid 59. It could be made of a curing-type adhesive or sealant (e.g., epoxy, or RTV-type silicone sealant) or it could be a layer of gasket material. If a curing-type adhesive or sealant were used, it would also help to keep the plastic grid 59 adhered to the evaporator plate 50 and promote heat transfer between the evaporator plate 50 and the plastic grid 59. There is also shown a layer of sealing material 100 between grid 59B and evaporator plate 50.

As illustrated in FIG. 10, pegs 98 and holes 99 are located in the same planes as the vertical ridges 63 of plastic grids 59. That is, when looking at evaporator assembly 26 in FIG. 4, they are located beneath the vertical ridges. Likewise, the pegs 98 and holes 99 are located between the refrigerant passages 52. It should also be noted that since plastic grids 59A and 59B are intended to be physically identical, the vertical ridges 63 and corresponding rows of pegs 98 or holes 99 must alternate in a way that allows two plastic grids 59 to mate properly (i.e., the pegs 98 and the holes 99 line-up with each other). This alternating but symmetric arrangement of the pegs 98 and the holes 99 is illustrated again in FIG. 11.

Figure 11:
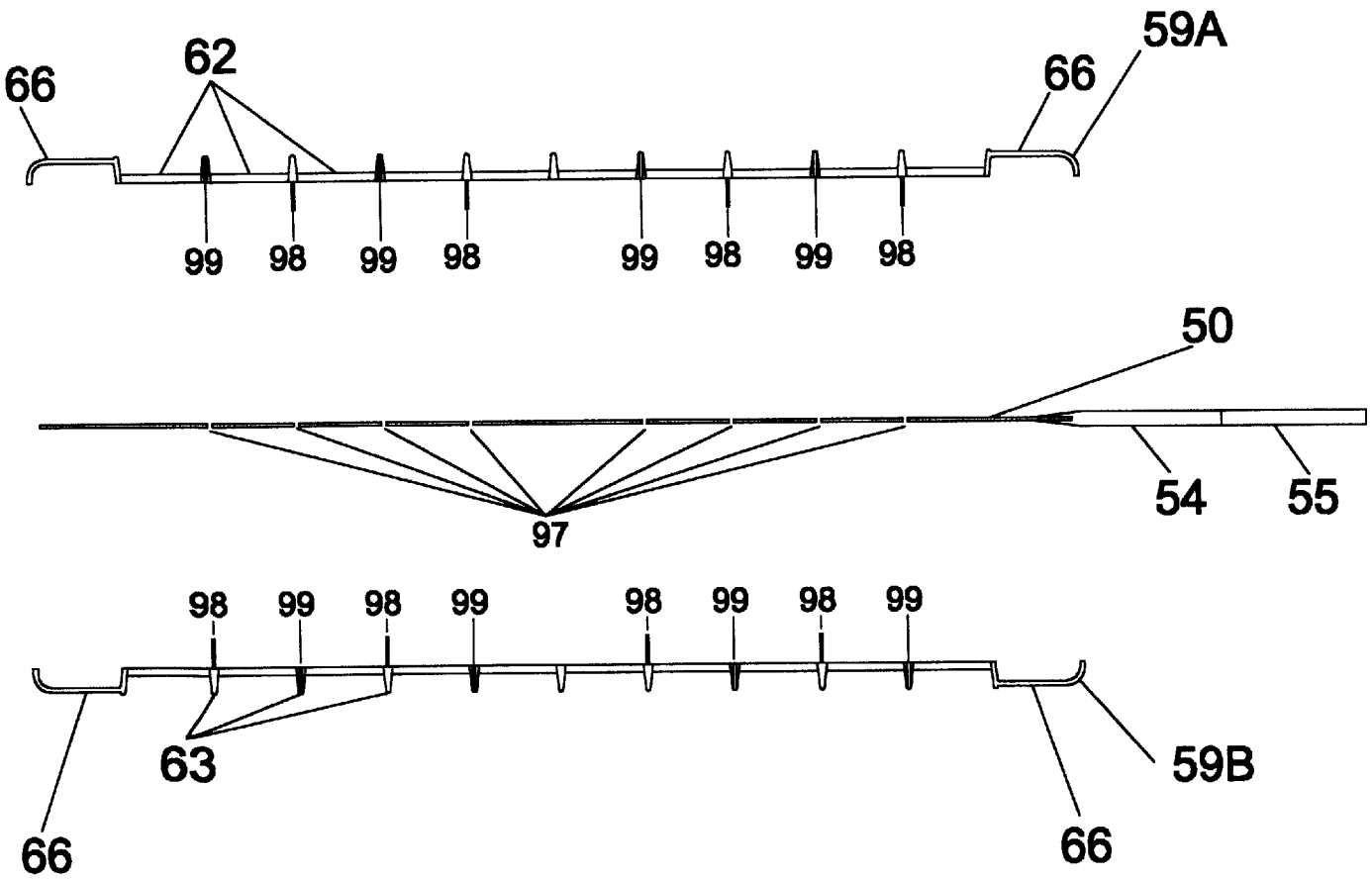
FIG. 11 is an exploded cross-sectional view of the evaporator assembly, taken along the line 3—3 of FIG. 4.

FIG. 11 is an exploded cross-sectional view of the evaporator assembly, taken along the line 3—3 of FIG. 4. It again shows plastic grids 59A and 59B located along either side of the evaporator plate 50, as they would be just prior to assembly. In this view the alternating and symmetric arrangement of the pegs 98 and the holes 99 can be seen. This arrangement allows plastic grids 59A and 59B to be identical yet also mate with each other properly. Also shown in FIG. 11 are the holes 97 in evaporator plate 50 through which the pegs 98 of grids 59 pass through for assembly.

Figure 12:
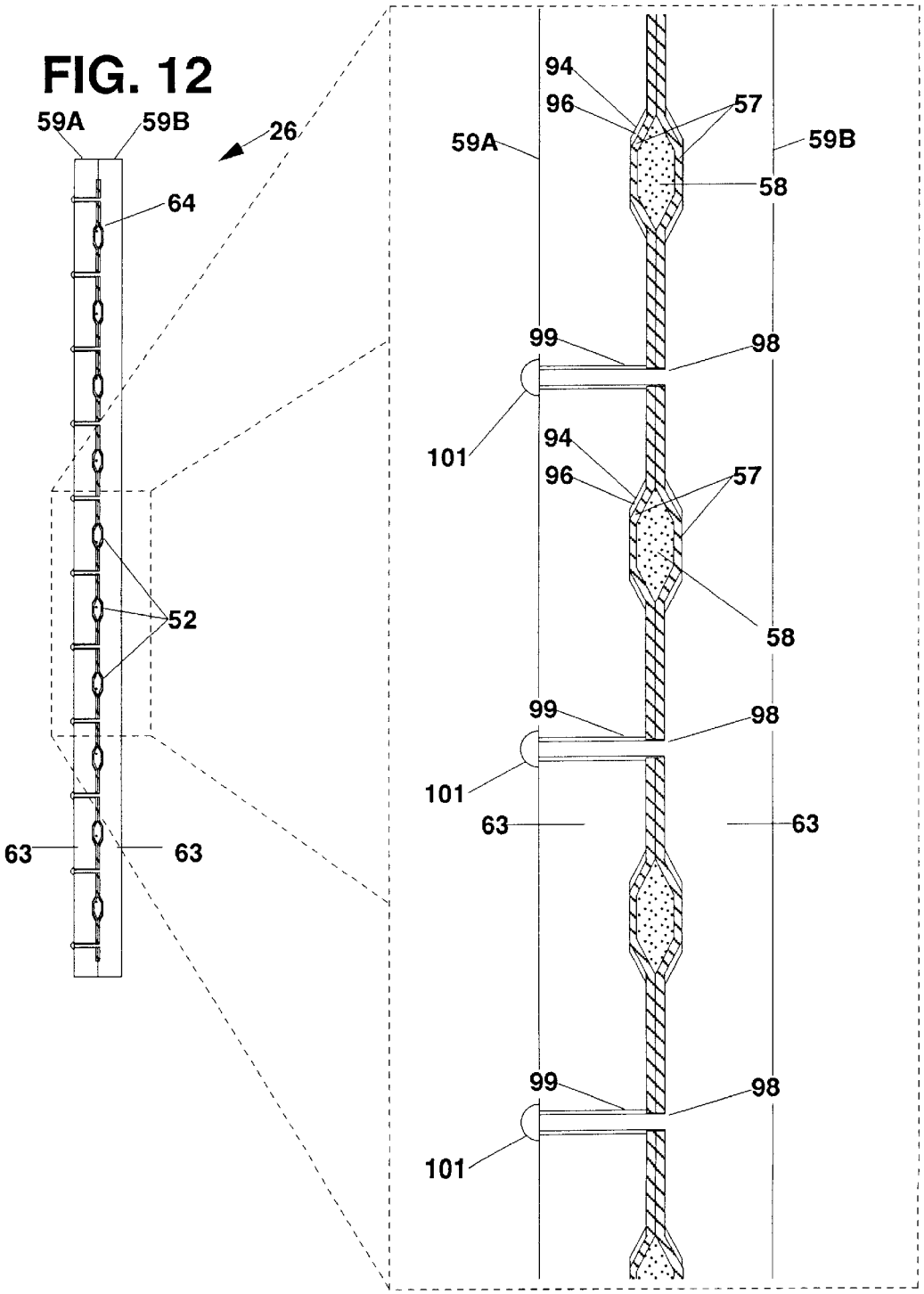
FIG. 12 is a cross-sectional view, taken along the line 5—5 of FIG. 4.

FIG. 12 is a cross-sectional view of the evaporator assembly, taken along the line 5—5 of FIG. 4, illustrating how it is assembled. It shows that the pegs 98 in grid 59B have been pushed through holes 97 in evaporator plate 50 and then into holes 99 in grid 59A. There are several means available to permanently secure the pegs 98 into holes 99—for example, the pegs 98 could be glued in place using some type of adhesive, or they could be welded in place using a solvent, thermal or ultrasonic welding. The preferred means of securing the pegs 98 into the holes 99 is to perform a thermal staking operation on pegs 98. Thermal staking involves deforming the end of peg 98 into a shape that cannot pull through hole 99. This is done by pushing on the ends of pegs 98 with a heated mandrel which softens and reforms the plastic at the end of peg 98. In FIG. 12 the ends 101 of pegs 98 are shown having been formed into hemispherical shape that will prevent them from pulling through holes 99. Thermal staking is very fast and requires no messy or toxic glues or solvents and provides very consistent, high-quality assembly.

Figure 13:
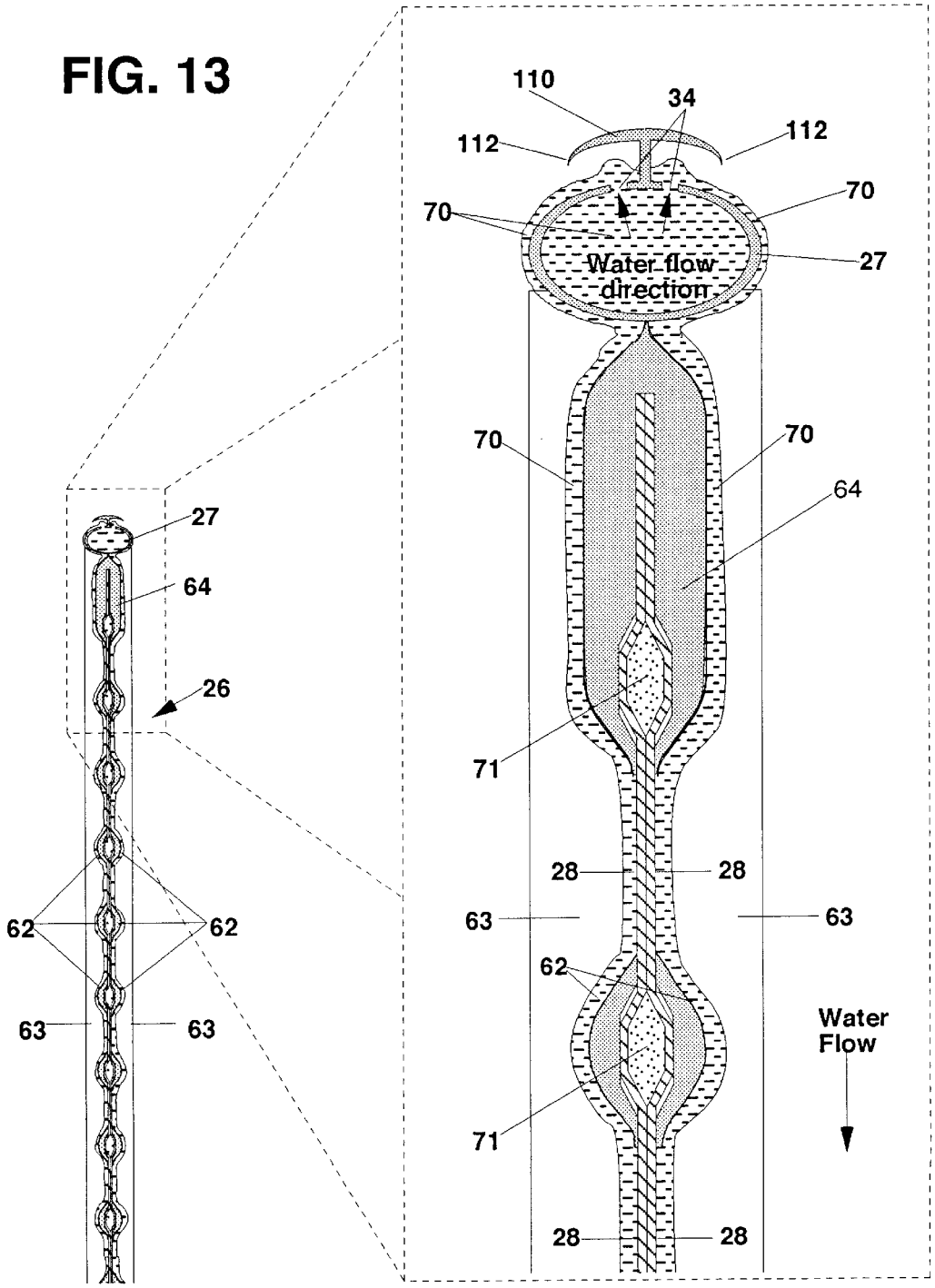
FIG. 13 is a cross-sectional view of the evaporator assembly taken along line 4—4 of FIG. 4, showing the water distribution tube located on top of the evaporator assembly.

FIG. 13 is a cross-sectional view of the evaporator assembly 26 taken along line 4—4 of FIG. 4 which shows the water distribution tube 27 located on top of the evaporator assembly 26. This water distribution tube 27 is unique in that the water 70 flows out of the tube 27 through holes 34 which are upward-facing. Typically the holes 34 in ice machine water tubes 27 face downward. By having the holes face upward, the water distribution tube becomes essentially self-cleaning—a very desirable property for a component in an ice machine.

In operation, water 70 flows in through the end of water distribution tube 27 (as can be seen in FIG. 1). The water 70 flows down the center of tube 27 (essentially down its longitudinal axis) and then flows out through a linear series of holes 34 located in the top of tube 27. This arrangement provides an even flow of water 70 across the full length, and both sides of evaporator assembly 26. Because the holes 34 are the smallest orifices through which the water circulates (once it is inside the ice machine), the holes 34 tend to act like filters, catching any debris in the water which is larger than the holes 34. If the holes 34 are downward-facing (as they usually are in an ice machine), this debris gets caught in the holes and stays there until someone manually cleans the holes. In some machines this catching of debris can eventually lead to a failure of the ice machine, as insufficient water is provided to the evaporator assembly 26. However with the upward-facing holes 34, each time the water flow is turned off (typically each ice making cycle, and also when the ice-receiving bin has been filled), the water 70 in the water distribution tube 27 drains out into the ice machine's water reservoir 30. As this draining starts, any debris plugging holes 34 will tend to be pulled by this back-flow of water 70 out of the hole 34 into the water tube 27 and into the water reservoir 30. Gravity also helps unplug the holes 34 once the water 70 begins draining from the tube, pulling the debris down and out of holes 34. Thus, by orienting the holes 34 in an upward direction, the water tube 27 is transformed into essentially a "self-cleaning" water tube.

Also shown in FIG. 13 is a water deflector 110. This deflector 110 becomes necessary when the ice machine experiences a phenomenon commonly referred to as a "slush-up". Normally, when water freezes in an ice machine, it simply cools down to 32° F. and then begins forming ice on the cold ice making surfaces. However, occasionally the ice-making water will sub-cool. That is, it will cool down to a temperature below 32° F. If that happens, when ice does start to form it will form as ice crystals, all at once, distributed throughout the water in the ice machine. These ice crystals, which are suspended in the ice making water, will tend to accumulate in, and clog, various parts of the water circulation system of the ice machine. Part of that clogging will occur in the water distribution tube 27 and the water distribution holes 34. When that occurs, the holes 34 that are not clogged by ice crystals will be forced to accommodate all of the water flow (i.e., much more water flow than normal). This causes the unclogged water distribution holes 34 to become little fountains, spraying water several inches above the water distribution tube 27. To prevent water from spraying all over the inside of the ice machine, a water deflector 110 is placed above the water distribution holes 34. This deflector 110 redirects any excessive water spray from holes 34, keeping the water flowing down across the evaporator assembly 26 surface.

The water deflector 110 should be removable from water tube 27 in order to make drilling or forming of holes 34 easier, and to allow easy cleaning of holes 34. The edges 112 of the deflector 110 should be curled downward and be located above the tube 27 so that any water flowing off of it will be directed onto the water tube 27 and will subsequently flow onto evaporator assembly 26. If the edges 112 of the deflector 110 are located beyond the sides of the water tube 27, it would be possible for water to undesirably flow or drip past the evaporator assembly 26 without flowing across it.

What is claimed is:

1. Apparatus for making ice comprising:

a refrigeration system including at least one evaporator assembly;

a water supply means for supplying water to the exterior surface of said evaporator assembly;

said evaporator assembly having a roll-bond metal plate with one or more integral serpentine refrigerant passages therethrough and having a grid of material attached to said plate, said grid comprising a series of horizontal and vertical ridges which define said array of discrete freezing sites such that the water flowing over said freezing sites will form individual ice cubes at said freezing sites.

2. The apparatus of claim 1 wherein the wherein said plate is constructed form at least one metal selected from the group consisting of: aluminum, aluminum alloy and copper.

3. The apparatus of claim 1 wherein said horizontal ridges have a sloped upper surface fixed at an angle relative to vertical of no more than 36 degrees.

4. The apparatus of claim 1 wherein said grid consists of injection molded plastic.

5. The apparatus of claim 4 wherein a sealing material may be interposed between said grid and said plate.

6. The apparatus of claim 4 wherein two of said grids are attached to said plate, one on either side of said plate.

7. The apparatus of claim 6 wherein said grids are attached to said plate by pegs disposed through said plate and affixed to each said grids.

8. The apparatus of claim 7 wherein said pegs are affixed to one or both of said grids by at least one means selected from the group consisting of: thermal staking, adhesives and welding.

9. The apparatus of claim 8 wherein said welding is selected from the group consisting of: solvent welding, thermal welding and ultrasonic welding.

10. The apparatus of claim 1 wherein said grid comprises end sections disposed about the periphery of said plate, thereby enclosing U-shaped bends on said plate.

11. The apparatus of claim 10 wherein said end sections comprise an insulation means capable of preventing extraneous ice growth and to prevent moisture condensation and freezing inside said end sections.

12. The apparatus of claim 1 wherein said water supply means includes a water distribution tube within said water supply means;

said water distribution tube being located on top of said evaporator assembly and including a linear series of upward-facing orifices at the top of said water distribution tube for the purpose of directing water across said evaporator assembly.

13. The apparatus of claim 12 wherein said water distribution tube has mounted above it a water deflecting device for preventing said orifices from spraying water anywhere but over the surface of said evaporator assembly.

14. Apparatus for making ice comprising:

a refrigeration system including at least one evaporator assembly:

a water supply means for supplying water to the exterior surface of said evaporator assembly;

a water distribution tube disposed within said water supply means;

said water distribution tube being located on top of said evaporator assembly and including a linear series of upward-facing orifices at the top of said water distribution tube for the purpose of directing water across said evaporator surface; and said water distribution tube having mounted above it a water deflecting device for preventing said orifices from spraying water anywhere but over the surface of said evaporator assembly.

15. A method for making ice which comprises:

supplying water to an exterior surface of an evaporator assembly, said evaporator assembly having a roll-bond metal plate with one or more integral serpentine refrigerant passages therethrough and having a grid of material attached to said plate, said grid comprising a series of horizontal and vertical ridges which define an array of discrete freezing sites on said plate such that the water flowing over said freezing sites will form individual ice cubes at said freezing sites.

16. The method of claim 15 wherein said supplying water step includes supplying water using a water distribution tube;

said water distribution tube being located on top of said evaporator assembly and including a linear series of upward-facing orifices at the top of said water distribution tube for the purpose of directing water across said evaporator assembly.

17. A method for making ice which comprises:

supplying water to an exterior surface of an evaporator assembly through a water supply means, said water supply means including a water distribution tube within said water supply means, said water distribution tube being located on top of said evaporator assembly and including a linear series of upward-facing orifices at the top of said water distribution tube for the purpose of directing water across said evaporator assembly, said water supply means further including a water deflecting device mounted above said water distribution tube for preventing said orifices from spraying water anywhere but over the surface of said evaporator assembly.

* * * * *